US008590897B1

(12) United States Patent
McCarey et al.

(10) Patent No.: US 8,590,897 B1
(45) Date of Patent: Nov. 26, 2013

(54) ROLE AND WAR PLAYING GAME

(76) Inventors: Micah McCarey, Athens, OH (US); Michael Wald, Oberlin, OH (US)

( * ) Notice: Subject to any disclaimer, the term of this patent is extended or adjusted under 35 U.S.C. 154(b) by 0 days.

(21) Appl. No.: 13/526,138

(22) Filed: Jun. 18, 2012

(51) Int. Cl.
*A63F 3/00* (2006.01)

(52) U.S. Cl.
USPC ..... 273/255; 273/287

(58) Field of Classification Search
USPC ..... 273/255, 287, 262
See application file for complete search history.

(56) References Cited

U.S. PATENT DOCUMENTS

| | | | | | |
|---|---|---|---|---|---|
| 3,123,360 | A | * | 3/1964 | Peckham | 273/237 |
| 3,724,852 | A | * | 4/1973 | Payne, Jr. | 273/247 |
| 3,730,528 | A | * | 5/1973 | Corrado | 273/247 |
| 3,817,524 | A | * | 6/1974 | Board | 273/247 |
| 3,895,799 | A | * | 7/1975 | Rinne | 273/240 |
| 4,082,437 | A | * | 4/1978 | Williams | 352/123 |
| D310,391 | S | | 9/1990 | Leblanc | |
| 5,018,728 | A | * | 5/1991 | Liss | 273/459 |
| 5,662,332 | A | | 9/1997 | Garfield | |
| 5,954,332 | A | | 9/1999 | Mero et al. | |
| 6,322,077 | B1 | | 11/2001 | Braunlich et al. | |
| 6,561,513 | B1 | | 5/2003 | DeGeorge | |
| 6,601,851 | B1 | | 8/2003 | Sakamoto et al. | |
| 7,118,107 | B2 | | 10/2006 | Niedner et al. | |
| 7,144,013 | B2 | | 12/2006 | Tanaka | |
| 7,469,901 | B1 | | 12/2008 | Hilliard | |
| 2006/0038349 | A1 | | 2/2006 | Meeks | |

* cited by examiner

*Primary Examiner* — Vishu K. Mendiratta

(57) ABSTRACT

A role playing game having a plurality of character cards with a surface on which a character summary is written and includes at least a Character Name, Character Information, and Character Abilities, a board having a status bar with indicators that can slide between actions, a dodge meter that can move to indicate a number of dodges available, a stamina wheel that can rotate to indicate a number of stamina points available, a character spot for accepting a character card, a Solo Defense Bar with indicators to indicate a number of defense points available, a Team Defense Bar with indicators that can slide to indicate a number of defense points available, and an Enhancement Bar with an indicator that can slide to indicate a number of lives remaining or a value of enhancement points, a plurality of Numbered Ability Cards and Special Ability Cards.

3 Claims, 5 Drawing Sheets

Character Card

Numbered Ability Card

Special Ability Card

Game Set-up

ROLE AND WAR PLAYING GAME

FIELD OF THE INVENTION

The present invention is directed to a game for providing entertainment and providing competition amongst fictional characters.

BACKGROUND OF THE INVENTION

The game of the present invention combines collectable character cards with unique game boards that streamline interactions among characters and players. The game features "ability cards," which create character moves and game dynamics. Players strategically implement the offensive and defensive abilities of their characters and teams to triumph over the attacks of opponents' characters. The winning player is determined through either the last team standing (e.g., for two-player games) or a point system (e.g., for three or more players).

SUMMARY

The present invention features a role and war playing game. In some embodiments, the role playing game comprises a plurality of character cards, each character card has a surface on which a character summary is written, the character summary includes at least: a Character Name; Character Information including (1) Origin; (2) Max Stamina; and (3) Threshold; Character Abilities including (1) Force Field; (2) Telekinetic Offence; (3) Energy Blast; (4) Teleportation; (5) Energy Reflection; and (6) Atomic Explosion, each character ability has a number; Resiliencies; and Special Vulnerabilities; a board comprising: a status bar with indicators that can slide between "enabled," "disabled," "reflect" "absorb," and "absorb and reflect;" a dodge meter that can move between 0, 1, 2, 3, and 4 to indicate a number of dodges a character has available; a stamina wheel that can rotate between 0, 1, 2, 3, 4, 5, 6, 7, 8, 9, 10, 11, 12, 13, 14, 15, 16, 17, 18, 19, and 20 to indicate a number of stamina points a character has available; a character spot for accepting a character card; a Solo Defense Bar with indicators that can slide between 0, 1, 2, 3, 4, 5, 6, 7, 8, 9, 10, 11, 12, 13, 14, 15, 16, 17, 18, 19, and 20 to indicate a number of defense points a character has available; a Team Defense Bar with indicators that can slide between 0, 1, 2, 3, 4, 5, 6, 7, 8, 9, 10, 11, 12, 13, 14, 15, 16, 17, 18, 19, and 20 to indicate a number of defense points a team has available; and an Enhancement Bar with an indicator that can slide between 0, 1, 2, 3, 4, 5, 6, 7, 8, and 9 to indicate a number of lives remaining or a value of enhancement points of a character; a plurality of Numbered Ability Cards, each Numbered Ability Card has a number; and a plurality of Special Ability Cards, each Special Ability Card has an instruction.

In some embodiments, a symbol is used to describe a character ability, the symbol is selected from the group consisting of: an attack symbol, a defense symbol, a physical attack symbol, a mystic symbol, a fire symbol, an ice symbol, an energy attack symbol, a gas symbol, a psychic symbol, a projectile symbol, an explosive symbol, a magnetic symbol, an electric symbol, a technological symbol, a stamina boost symbol, a meteor rock symbol, an essence ball symbol, and a restraint symbol.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
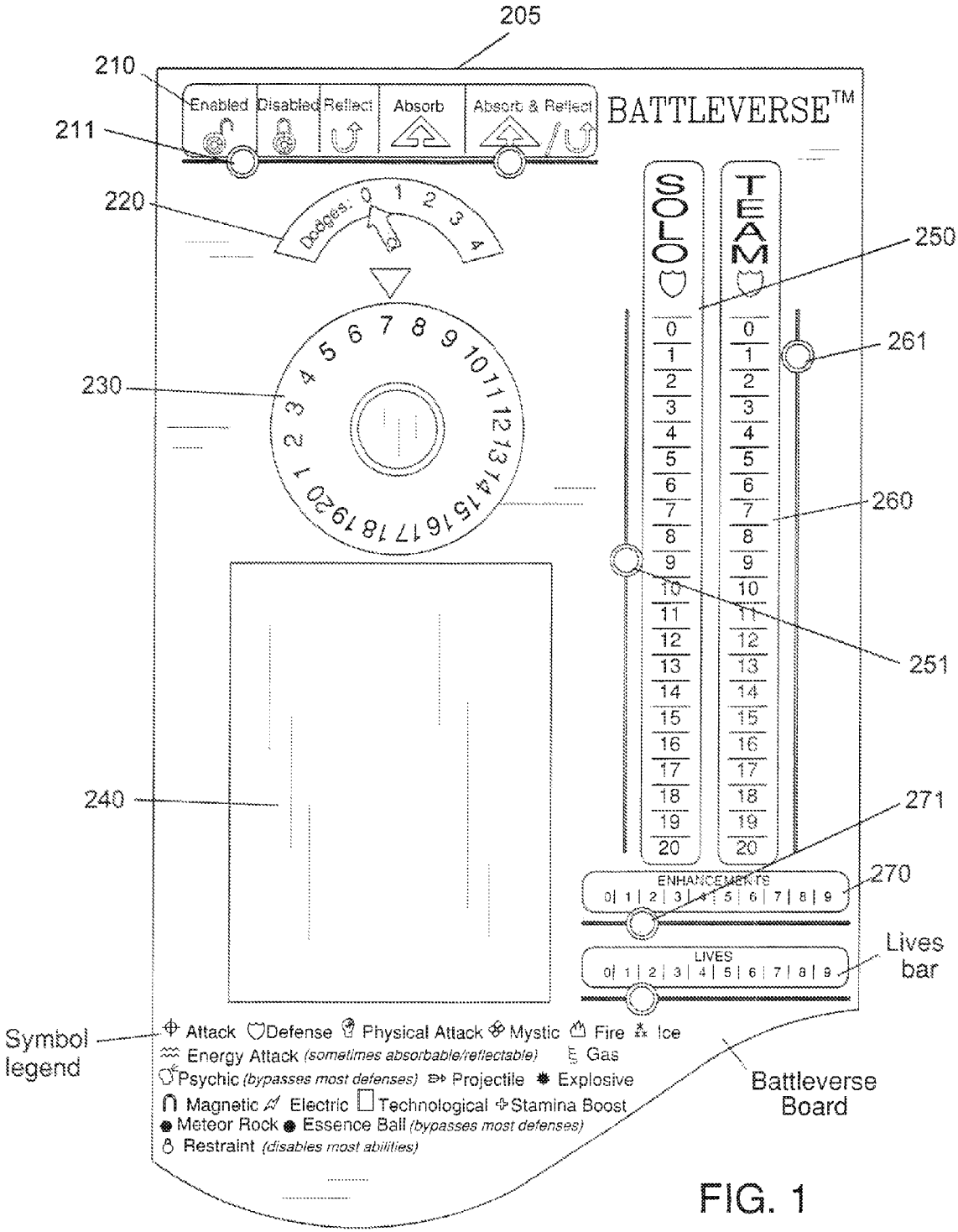
FIG. 1 is a top view of a board of the game of the present invention.
Figure 2:
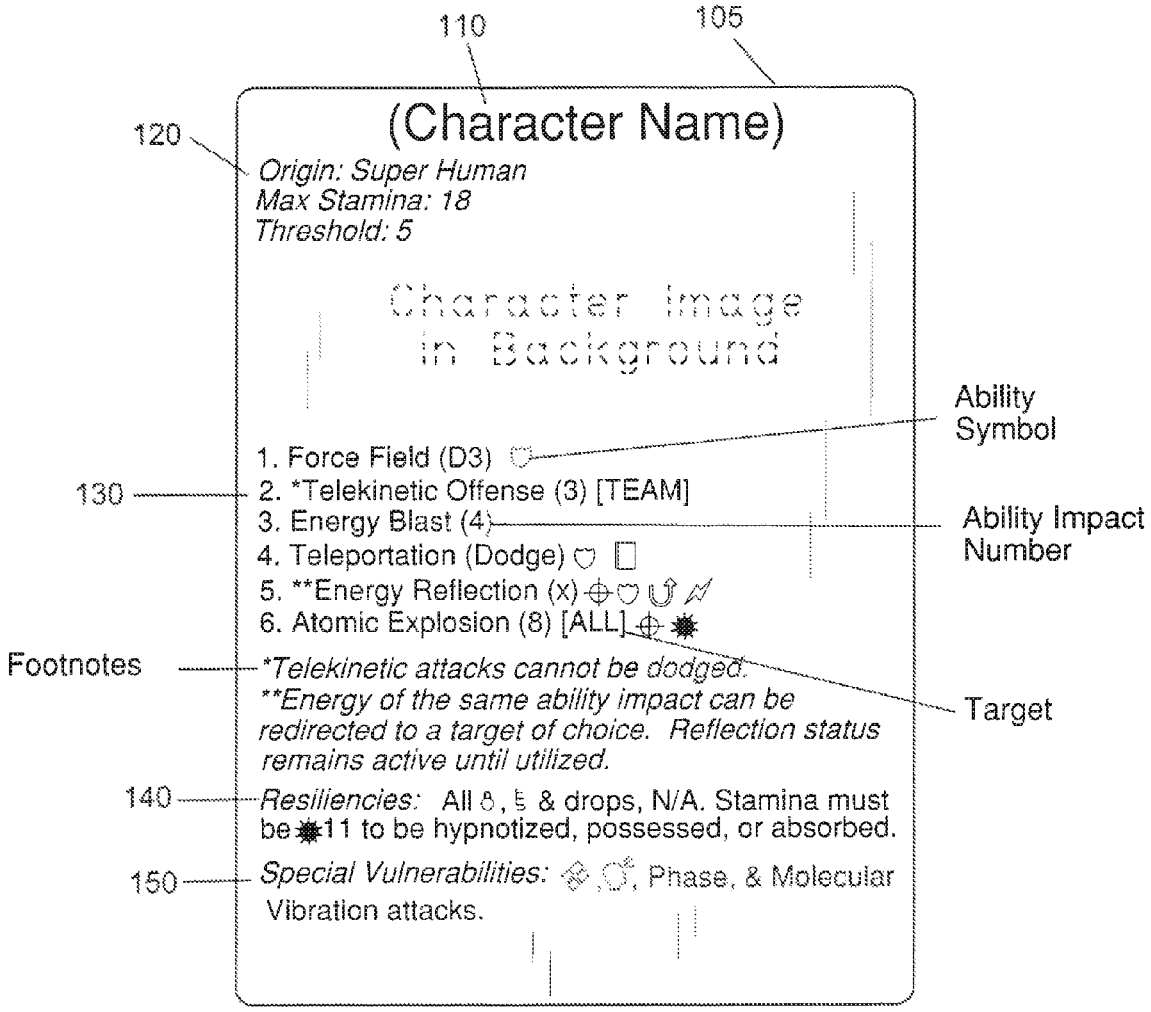
FIG. 2 is a top view of a Character Card of the game of the present invention.
Figure 3:
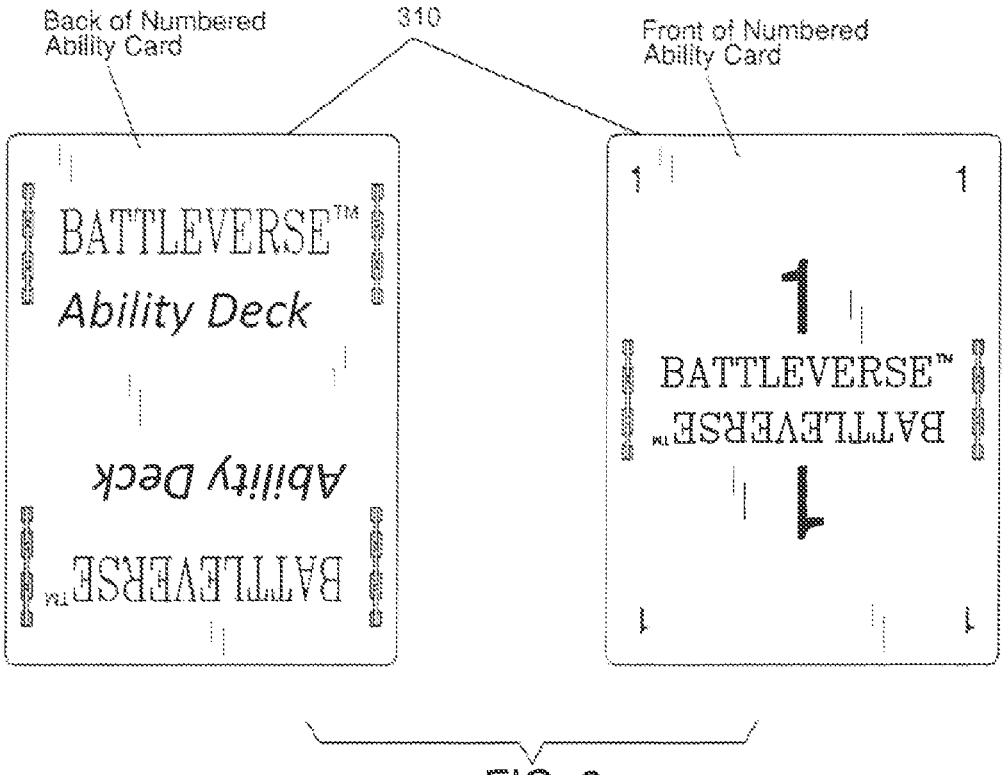
FIG. 3 is a top and bottom view of a Numbered Ability Card of the game of the present invention.
Figure 4:
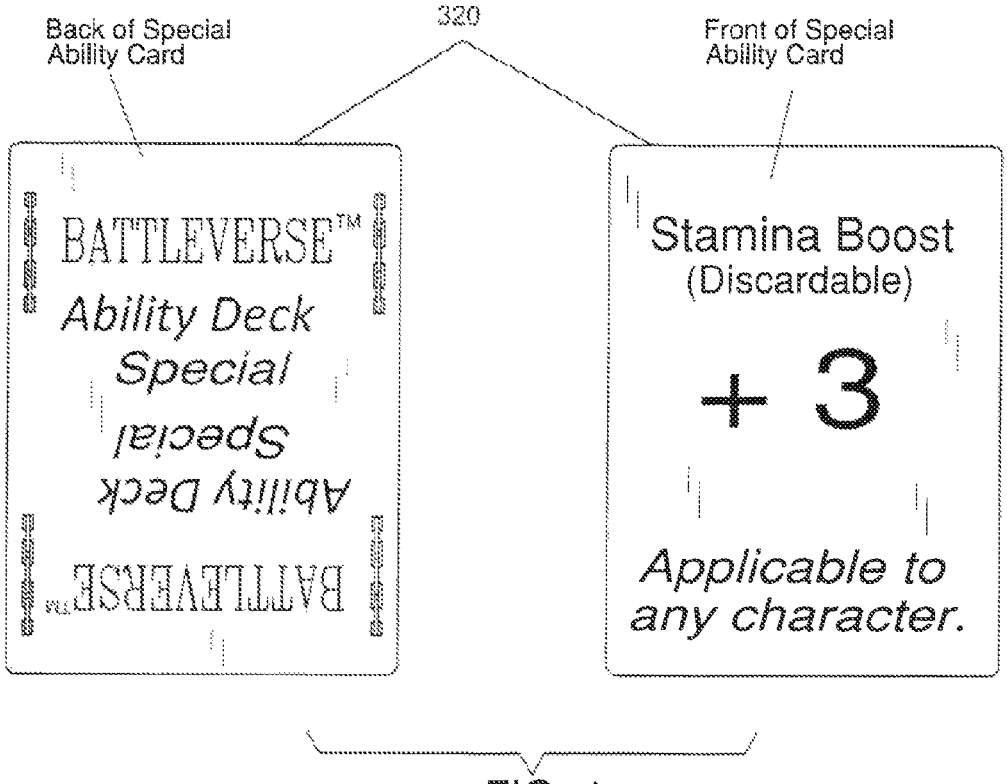
FIG. 4 is a top and bottom view of a Special Ability Card of the game of the present invention.
Figure 5:
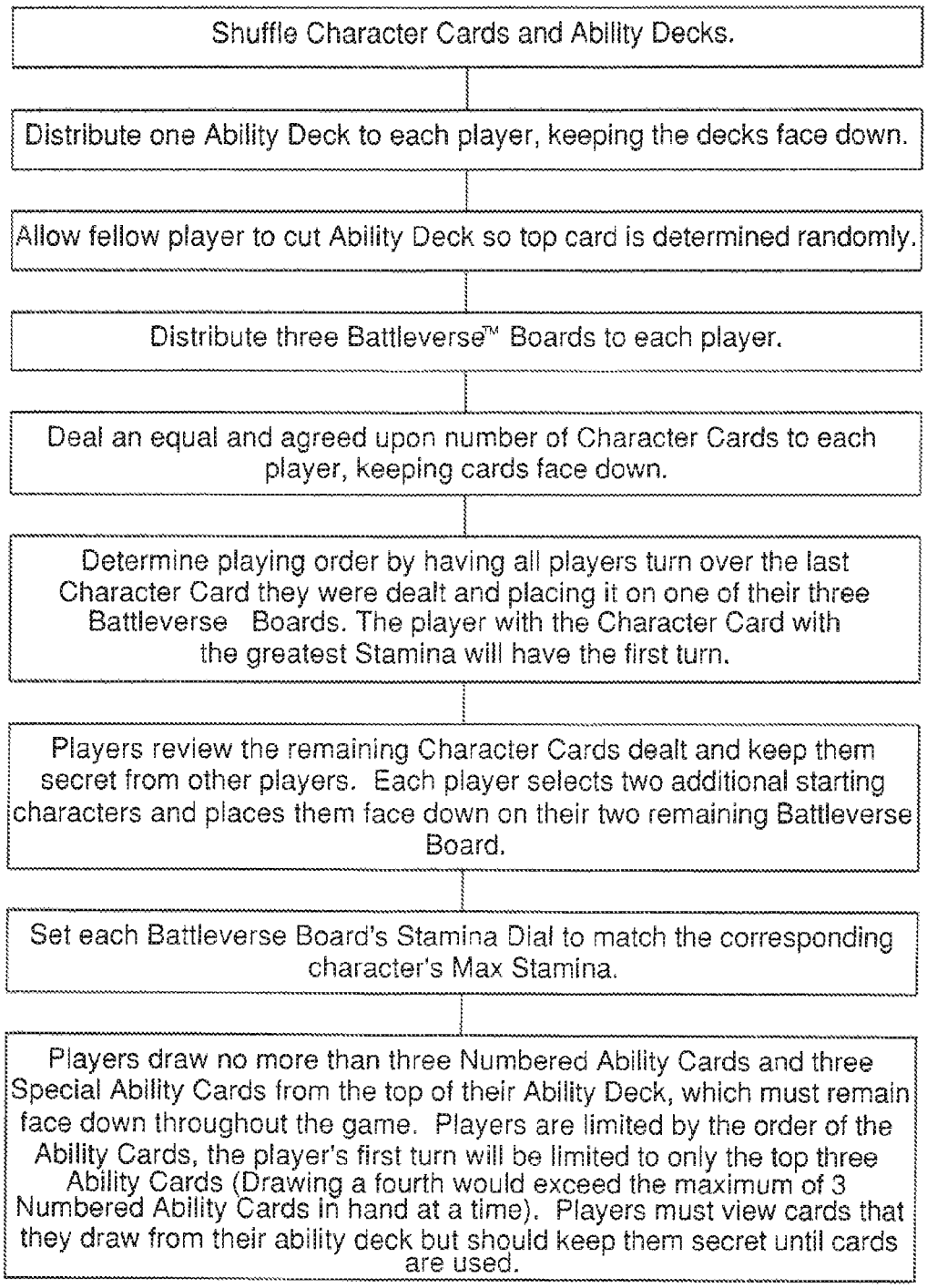
FIG. 5 is a flow chart showing steps for game play of the game of the present invention.

Referring now to FIG. 1-5, the present invention features a role playing game.

Game Components

The game of the present invention comprises a plurality of character cards. Players are dealt a number of character cards that represent specific characters.

Each character card 105 has a surface on which a character summary is written. A character summary includes (1) Character Name 110, (2) Character Information 120, (3) Character Abilities 130, (4) Resiliencies 140, and (5) Special Vulnerabilities 150.

Character Information 120 may include (1) Origin; (2) Max Stamina; and (3) Threshold. The Origin can influence susceptibility to particular attacks. The Max Stamina (maximum stamina) indicates the number of stamina points with which the character begins. Threshold indicates how strong an attack must be to affect the character, for example characters with a threshold are immune to attacks inflicting fewer damage points than the number corresponding to the threshold (unless that attack is listed as a special vulnerability).

Character Abilities 130 may include: (1) Force Field; (2) Telekinetic Offence; (3) Energy Blast; (4) Teleportation; (5) Energy Reflection; (6) Atomic Explosion. Character abilities are numbered (as described above, e.g., 1-6) to denote which numbered ability card must be played in order to activate a particular ability. Symbols may be used to describe the character's abilities. For example, symbols next to each of the character's abilities classify the ability as offensive and/or defensive and denote key qualities of the ability. Symbols may include but are not limited to an attack symbol, a defense symbol, a physical attack symbol, a mystic symbol, a fire symbol, an ice symbol, an energy attack symbol (e.g., sometimes absorbable/reflectable), a gas symbol, a psychic symbol (e.g., bypasses most defenses), a projectile symbol, an explosive symbol, a magnetic symbol, an electric symbol, a technological symbol, a stamina boost symbol, a meteor rock symbol, an essence ball symbol (e.g., bypasses most defenses), and/or a restraint symbol (e.g., disables most abilities).

Impact Numbers may be used to describe the character's abilities. For example, numbers in parentheses may denote the number of damage or defensive points provided by the ability. Targets are described in the character's abilities, which indicates that use of that offensive ability will reach a particular subset (or all) characters. For example, "All" indicates that the user of that offensive ability will reach all active characters including teammates but not the character activating the ability. "Team" when next to an offensive ability indicates that the use of that offensive ability will reach all members of the targeted team. "Team" when next to a defensive ability indicates that the defense applies equally to all active characters on the team of the character initiating the defense. If neither "All" or "Team" appear next to an offensive ability, that ability can only be used against one active opponent. If neither "All" or "Team" appear next to a defensive ability, that ability can only be used for the character initiating the defense.

Resiliencies 140 describes types of attacks that are not applicable, for example some character cards indicate that particular kinds of attacks are not applicable to that character (e.g., causes no damage). Special Vulnerabilities 150 describes attacks to which the character is especially vulnerable.

Optionally, footnotes are included on the character summary, which serve to describe or explain information on the character summary.

The game further comprises a board 205. One board 205 is assigned to each active character for use in monitoring status of stamina and defense status. Each board 205 comprises a status bar 210 with indicators 211 that can slide along a track between "enabled," "disabled," "reflect" "absorb," and "absorb and reflect."

The board 205 further comprises a dodge meter 220, which is an arrow that can move between 0, 1, 2, 3, and 4. The dodge meter 220 indicates the number of dodges the character has available.

The board 205 further comprises a stamina wheel 230, which is a dial that can rotate between 0, 1, 2, 3, 4, 5, 6, 7, 8, 9, 10, 11, 12, 13, 14, 15, 16, 17, 18, 19, and 20. The stamina wheel 230 indicates the number of stamina points that the character has available.

The board 205 further comprises a character spot 240, which is a space for accepting the card 105 of the character.

The board 205 further comprises a Solo Defense Bar 250 with indicators 251 that can slide along a track between 0, 1, 2, 3, 4, 5, 6, 7, 8, 9, 10, 11, 12, 13, 14, 15, 16, 17, 18, 19, and 20. The Solo Defense Bar 250 describes the number of defense points the character has available. The board 205 further comprises a Team Defense Bar 260 with indicators 261 that can slide along a track between 0, 1, 2, 3, 4, 5, 6, 7, 8, 9, 10, 11, 12, 13, 14, 15, 16, 17, 18, 19, and 20. The Team Defense Bar 260 describes the number of defense points the team has available.

The board 205 further comprises an Enhancement Bar 270 with an indicator 271 that can slide along a track between 0, 1, 2, 3, 4, 5, 6, 7, 8, and 9. The Enhancement Bar 270 indicates the number of lives remaining (e.g., usually zero) or the total value of enhancement points of the character's abilities.

In some embodiments, the board 205 further comprises a legend for reference. The legend may describe the symbols, for example an attack symbol, a defense symbol, a physical attack symbol, a mystic symbol, a fire symbol, an ice symbol, an energy attack symbol (e.g., sometimes absorbable/reflectable), a gas symbol, a psychic symbol (e.g., bypasses most defenses), a projectile symbol, an explosive symbol, a magnetic symbol, an electric symbol, a technological symbol, a stamina boost symbol, a meteor rock symbol, an essence ball symbol (e.g., bypasses most defenses), and/or a restraint symbol (e.g., disables most abilities).

The game further comprises Ability Decks, for example a plurality of Numbered Ability Cards 310 forming a Numbered Ability Deck and a plurality of Special Ability Cards 320 forming a Special Ability Deck. The Numbered Ability Cards 310 each have a number. Players draw Numbered Ability Cards 310 and the number on the card corresponds to the number of the Character Ability that is activated. For example, if the number "1" is on the card, then the Force Field is activated (or whichever ability is #1). In some embodiments, one or more Numbered Ability Cards 310 are Character Combo cards, which allow a character to activate multiple abilities in the same turn. Special Ability Cards 320 have instructions that the player is to follow. The instructions may allow a player the opportunity to change the course a normal turn by enhancing characters' powers, initiating a double team or team attack, tagging out characters, etc.

Game Setup

1. Shuffle Character Cards 105 and decks, e.g., Numbered Ability Cards 310 and Special Ability Cards 320 (keeping the decks separate).

2. Distribute one Ability Deck to each player, keeping the decks face-down so that no one knows the order of any deck's cards.

3. Allow a fellow player to cut the ability deck so that the top card is determined randomly as opposed to being determined by when the user stops shuffling.

4. Distribute three boards 205 to each player,

5. Deal an equal and agreed upon number of Character Cards 105 to each player, keeping the cards face down. The more Character Cards 105 dealt, the longer the game will last.

6. Determine turn-order by having all players turn over and the last Character Card 105 they were dealt and place it on one of their three Boards. The player revealing the Character Card with the greatest Stamina will have the first turn.

7. Players review the remaining Character Cards that they were dealt and keep them secret from other players. Each player selects two additional starting characters and places those characters face down on their two remaining Boards.

8. Set each Board's Stamina Dial to match the corresponding character's Max Stamina.

9. Players draw no more than three Numbered Ability cards and three Special ability cards from the top of their Ability Deck, which must remain face down throughout the game, Players are limited by the order of the Ability Cards in their deck. If the top four cards of a player's ability deck are all Numbered Ability Cards, the player's first turn will be limited to only the top three Ability Cards (Drawing a fourth would exceed the maximum of 3 Numbered Ability Cards in hand at a time). Players must view the cards that they draw from their ability deck but should keep them secret until cards are used.

Game Play

1. A standard turn using a Numbered Ability Card requires the application of a player's Numbered Ability Card to one of his/her characters. The only condition negating this requirement occurs when a player is unable to use any of the three Ability Cards in his/her hand. In this rare situation, discarding one of the unusable Ability Cards and replacing it with another card from the ability deck constitutes the player's turn.

A. Normal Attacks. When the Numbered Ability Card played activates an offensive ability of a character that is not marked as effecting "[ALL]" active characters or all active character's on an opponent's "[TEAM]," the player must chose and announce the character to whom the attack was directed.

B. Offensive "[ALL]" Attacks. When the Numbered Ability Card played activates an offensive ability of a character marked as effecting "[ALL]" active characters, the only characters that can escape damage are the character activating the ability and characters protected by applicable defenses/ thresholds. All susceptible characters must subtract the specified number of stamina points caused by the attack from their individual stamina dial.

C. Offensive "[TEAM]" Attacks. When the Numbered Ability Card played activates an offensive ability of a character marked as effecting a "[TEAM]," the player must chose and announce the team to which the attack was directed so that all susceptible characters on that team can subtract the specified number of stamina points from their stamina dials.

D. Normal Defenses. When the Numbered Ability Card played activates a character's defensive ability that is not marked as effecting others on that character's "[TEAM]," only the character activating the defense may benefit from the defense points, dodges, or stamina boost provided. Defense points should be tracked on the "SOLO" Defense Bar because teammates are not benefiting from the defense. Dodges should be tracked using the dodge meter. Stamina boosts should be tracked on the stamina wheel.

E. "[TEAM]" Defenses. When the Numbered Ability Card played activates a character's defensive ability marked as effecting others on that character's "[TEAM]," all active characters on that team may benefit from the defense points, dodges, or stamina boost provided. Defense points should be tracked on the "SOLO" Defense Bar of the character activating the defense and on the "[TEAM]" Defense Bar of characters benefiting from the defense that their teammate activated. Dodges should be tracked on each team member's dodge meter. Stamina boosts should be tracked on each team member's stamina wheel.

2. A standard turn using a "Character Combo" closely resembles a standard turn using a Numbered Ability Card and requires the application of a player's Character Combo Card to one of his/her characters. Each Character Combo Card specifies the numbers and/or types of abilities that may be used by the character benefiting from the Character Combo, Character Combos may be directed to one character on an opponent's team or spread across members of an opponent's team but may only spread across teams when the Character Combo includes an "[ALL]" attack.

3. A turn involving the use of special ability cards can allow a player to apply multiple defensive and offensive strategies and even abilities in a single turn. All Special Ability Cards played during a turn must be used before the final Numbered Ability Card of that turn is played. Since a player must always have three ability cards in hand, a player is permitted to replace used special ability cards with additional cards from the top of his/her Ability Deck during the turn. The player should abide by the notes and instructions included on each Ability Card. Examples of how Special Ability Cards might be used are as follows.

A. A player with a "Force-Field Restraint," "Ability 1," and an "Ability 4" card in hand might (1) apply the "Force-Field Restraint," to an opponent's character, (2) draw an Ability 6 card so that he/she still has three cards in hand, and (3) apply one of his/her numbered ability cards before bringing the turn to an end.

B. A player with a "Force-Field Restraint," "Ability 1," and an "Ability 4" card in hand might (1) apply the "Force-Field Restraint," collar to an opponent's character, (2) draw a "Mutant Enhancement" card, (3) apply a "Mutant Enhancement" card to a specified character, (4) draw an "Ability 6" card, and (5) apply one of his/her numbered ability cards before bringing the turn to an end.

C. A player with a "Team Attack," "Mutant Enhancement," and an "Ability 4" card in hand might (1) apply the "Team Attack," (2) draw a "Force-Field Restraint," card, (3) apply the "Mutant Enhancement" and "Force-Field Restraint," cards to specified characters, (4) draw an "Ability 6" card and an "Ability 2" card, (5) Apply the "Ability 4" card to the first specified character involved in the "Team Attack," (6) Draw an "Ability 1" Card, (7) Apply the "Ability 2" card to the second character specified in the "Team Attack," (8) Draw another "Ability 1" card, and (9) apply one of his/her numbered ability cards to the final character specified in the "Team Attack" before bringing the turn to an end.

4. Turntaking proceeds in clockwise rotation beginning with the player who initially drew the character with greatest Max Stamina.

5. Unwanted Special Ability Cards may be discarded in any quantity during a players turn, allowing that player to draw new Ability Cards from the top of his/her Ability Deck.

6. A character's application of passive regeneration should be announced and applied prior to the end of a player's turn, but can be applied soon after the end of that turn if all players agree that a recent opportunity for a character to passively regenerate was missed. Passive regeneration is not optional.

7. A player's turn ends after he/she applies an Ability Card, or, in the case of "Double Team" and "Team Attacks," a turn ends after a player applies the final Ability Card necessary to ensure that each character has been used.

Note: Characters on the same team are only permitted to "attack" one another (i.e. use "friendly fire" against) when doing so changes character origin (e.g., a character converts a teammate into a vampire).

Determining the Winner

1. The winning player of a two player game can be determined most easily by the "last team standing," meaning that the player has defeated all of the characters on the opposing team.

2. The winning player of a game involving more than two players can be determined through use of the following point system with the player accumulating the most points being named "winner."

A. 5 points per defeated opponent characters with blue highlighting behind name (indicating normal difficulty).

B. 6 points per defeated opponent characters with yellow highlighting behind name (indicating intermediate difficulty).

C. 7 points per defeated opponent characters with red highlighting behind name (indicating advanced difficulty).

D.—5 points per character defeated by "friendly-fire."

The disclosures of the following U.S. Patents are incorporated in their entirety by reference herein; U.S. Design Pat. No. D310,391; U.S. Pat. No. 5,662,332; U.S. Pat. No. 5,954,332; U.S. Pat. No. 6,322,077; U.S. Pat. No. 6,561,513; U.S. Pat. No. 6,601,851; U.S. Pat. No. 7,118,107; U.S. Pat. No. 7,144,013; U.S. Pat. No. 7,469,901; U.S. Patent Application No. 2006/0038349.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A role playing game comprising:

(a) a plurality of character cards, each character card has a surface on which a character summary is written, the character summary includes at least:

(i) a character name;

(ii) character information including origin; max stamina; and threshold;

(iii) character abilities including force field; telekinetic offence; energy blast; teleportation; energy reflection; and atomic explosion, each character ability has a number;

(iv) resiliencies; and (v) special vulnerabilities;

(b) a board comprising:

(i) a status bar with a plurality of sliding indicators that can slide between "enabled," "disabled," "reflect" "absorb," and "absorb and reflect;"

(ii) an arc-shaped dodge meter having a dial that can move between 0, 1, 2, 3, and 4 to indicate a number of dodges a character has available;

(iii) a stamina wheel that can rotate between 0, 1, 2, 3, 4, 5, 6, 7, 8, 9, 10, 11, 12, 13, 14, 15, 16, 17, 18, 19, and 20 to indicate a number of stamina points a character has available;

(iv) a character spot for accepting a character card;

(v) a solo defense bar with indicators that can slide between 0, 1, 2, 3, 4, 5, 6, 7, 8, 9, 10, 11, 12, 13, 14, 15, 16, 17, 18, 19, and 20 to indicate a number of defense points a character has available;

(vi) a team defense bar with indicators that can slide between 0, 1, 2, 3, 4, 5, 6, 7, 8, 9, 10, 11, 12, 13, 14, 15, 16, 17, 18, 19, and 20 to indicate a number of defense points a team has available; and (vii) an enhancement bar with an indicator that can slide between 0, 1, 2, 3, 4, 5, 6, 7, 8, and 9 to indicate a number of lives remaining or a value of enhancement points of a character;

(c) a plurality of numbered ability cards, each numbered ability card has a number; and (d) a plurality of special ability cards, each special ability card has an instruction.

2. The game of claim 1, wherein a symbol is used to describe a character ability, the symbol is selected from the group consisting of: an attack symbol, a defense symbol, a physical attack symbol, a mystic symbol, a fire symbol, an ice symbol, an energy attack symbol, a gas symbol, a psychic symbol, a projectile symbol, an explosive symbol, a magnetic symbol, an electric symbol, a technological symbol, a stamina boost symbol, a meteor rock symbol, an essence ball symbol, and a restraint symbol.

3. A role playing game consisting of:

(a) a plurality of character cards, each character card has a surface on which a character summary is written, the character summary includes at least:

(i) a character name;

(ii) character information including origin; max stamina; and threshold;

(iii) character abilities including force field; telekinetic offence; energy blast; teleportation; energy reflection; and atomic explosion, each character ability has a number;

(iv) resiliencies; and (v) special vulnerabilities;

(b) a board consisting of:

(i) a status bar with a plurality of sliding indicators that can slide between "enabled," "disabled," "reflect" "absorb," and "absorb and reflect;"

(ii) an arc-shaped dodge meter having a dial that can move between 0, 1, 2, 3, and 4 to indicate a number of dodges a character has available;

(iii) a stamina wheel that can rotate between 0, 1, 2, 3, 4, 5, 6, 7, 8, 9, 10, 11, 12, 13, 14, 15, 16, 17, 18, 19, and 20 to indicate a number of stamina points a character has available;

(iv) a character spot for accepting a character card;

(v) a solo defense bar with indicators that can slide between 0, 1, 2, 3, 4, 5, 6, 7, 8, 9, 10, 11, 12, 13, 14, 15, 16, 17, 18, 19, and 20 to indicate a number of defense points a character has available;

(vi) a team defense bar with indicators that can slide between 0, 1, 2, 3, 4, 5, 6, 7, 8, 9, 10, 11, 12, 13, 14, 15, 16, 17, 18, 19, and 20 to indicate a number of defense points a team has available; and (vii) an enhancement bar with an indicator that can slide between 0, 1, 2, 3, 4, 5, 6, 7, 8, and 9 to indicate a number of lives remaining or a value of enhancement points of a character;

(c) a plurality of numbered ability cards, each numbered ability card has a number; and (d) a plurality of special ability cards, each special ability card has an instruction.

* * * * *